US012215436B2

(12) United States Patent
Fray et al.

(10) Patent No.: US 12,215,436 B2
(45) Date of Patent: Feb. 4, 2025

(54) TREATMENT OF METAL ORES

(71) Applicant: CHINUKA LTD, London (GB)

(72) Inventors: Derek Fray, Great Shelford (GB); Paul Coxon, Cambridge (GB)

( * ) Notice: Subject to any disclaimer, the term of this patent is extended or adjusted under 35 U.S.C. 154(b) by 0 days.

(21) Appl. No.: 18/704,041

(22) PCT Filed: Oct. 7, 2022

(86) PCT No.: PCT/GB2022/052540
§ 371 (c)(1),
(2) Date: Apr. 23, 2024

(87) PCT Pub. No.: WO2023/105180
PCT Pub. Date: Jun. 15, 2023

(65) Prior Publication Data

US 2024/0328021 A1 Oct. 3, 2024

(30) Foreign Application Priority Data

Dec. 7, 2021 (GB) ..... 2117645

(51) Int. Cl.

| | |
|---|---|
| ***C25C 3/00*** | (2006.01) |
| ***C25C 3/12*** | (2006.01) |
| ***C25C 3/26*** | (2006.01) |
| ***C25C 7/02*** | (2006.01) |
| ***C25C 7/06*** | (2006.01) |

(52) U.S. Cl.
CPC ..... *C25C 3/125* (2013.01); *C25C 3/26* (2013.01); *C25C 7/025* (2013.01); *C25C 7/06* (2013.01)

(58) Field of Classification Search
CPC ..... C25C 3/125; C25C 3/26; C25C 7/025; C25C 7/06
See application file for complete search history.

(56) References Cited

U.S. PATENT DOCUMENTS

| | | | |
|---|---|---|---|
| 2,722,509 | A | 11/1955 | Wainer |
| 2014/0116888 | A1 | 5/2014 | Mu et al. |
| 2016/0258074 | A1 | 9/2016 | Fray et al. |

FOREIGN PATENT DOCUMENTS

| | | | |
|---|---|---|---|
| CN | 101187042 | A | 5/2008 |
| CN | 101949038 | A | 1/2011 |
| GB | 2472496 | A | 2/2011 |

(Continued)

OTHER PUBLICATIONS

Chunlin et al., "Purification and Phase Evolution Mechanism of Titanium Oxycarbide ($TiC_xO_y$) Produced by the Thermal Reduction of Ilmenite," Minerals, vol. 11, No. 2, pp. 1-17, Jan. 21, 2021 (17 pp.).

(Continued)

*Primary Examiner* — Zulmariam Mendez
(74) *Attorney, Agent, or Firm* — FisherBroyles, LLP

(57) ABSTRACT

A method of refining a metal (e.g. titanium), comprising the following steps: (a) providing (10) an oxide of the metal having a level of impurities of at least 1.0 wt %; (b) reacting (12) the oxide of the metal to form an oxycarbide by providing an electrode comprising the oxide of the metal and carbon, and electrolytically reducing the electrode in a molten calcium chloride electrolyte; (c) electrolysing (14) the oxycarbide in an electrolyte, with the oxycarbide configured as an anode; and (d) recovering (16) a refined form of the metal from a cathode in the electrolyte.

11 Claims, 4 Drawing Sheets

(56) References Cited

FOREIGN PATENT DOCUMENTS

| | | |
|---|---|---|
| WO | WO 2005/019501 | 3/2005 |
| WO | WO 2007/097823 | 8/2007 |
| WO | WO 2011/015845 | 2/2011 |

OTHER PUBLICATIONS

Combined Search and Examination Report from parent UK Pat. App. GB2117645.8, UK Intellectual Property Office, Jun. 9, 2022 (6 pp.).

Fatollahi-Fard et al., "Production of Titanium Oxycarbide from Iron-rich Titanium Ores," Proceedings of the 13$^{th}$ World Conference on Titanium, pp. 65-69, May 2, 2016 (5 pp.).

Fray, "Exploring Novel Uses of Molten Salts," ECS Transactions, vol. 50, No. 11, pp. 3-13, 2012 (11 pp.).

International Preliminary Report on Patentability from Int'l Pat. App. PCT/GB2022/052540, Mar. 18, 2024 (11 pp.).

International Search Report and Written Opinion from Int'l Pat. App. PCT/GB2022/052540, Feb. 22, 2023 (15 pp.).

Shang et al., "Novel Extraction of Zr Based on an In-Situ Preparation of $ZrC_xO_y$," Separation and Purification Technology, vol. 275, pp. 1-8 (8 pp.).

Zhang et al., "Electrochemical Synthesis of Titanium Oxycarbide in a $CaCl_2$ Based Molten Salt," Electrochimica Acta, vol. 75, pp. 357-359, May 10, 2012 (3 pp.).

Zhao et al., "Electrochemical Extraction of Titanium from Carbon-Doped Titanium Dioxide Precursors by Electrolysis in Chloride Molten Salt," Ionics, vol. 25, Jul. 11, 2019 (8 pp.).

Chen et al., "Direct Electrochemical Reduction of Titanium Dioxide to Titanium in Molten Calcium Chloride," Nature, vol. 407, pp. 361-364, Sep. 21, 2000 (4 pp.).

Hunter, "Metallic Titanium," J. Am. Chem. Soc., vol. 32, 3, pp. 330-336, Jan. 19, 1910 (7 pp.).

Kroll, "The Production of Ductile Titanium," Trans. Electrochem. Soc., vol. 78, 1, pp. 35-47, 1940 (14 pp.).

Shang et al., "Novel Extraction of Zr Based on an In-Situ Preparation of $ZrC_xO_y$," Separation and Purification Technology, vol. 275, pp. 1-8, Nov. 22, 2020 (8 pp.).

"Summary of Emerging Titanium Cost Reduction Technologies," EHKTechnologies, Jan. 2004 (59 pp.).

Suzuki et al., "Calciothermic Reduction of Titanium Oxide and in-situ Electrolysis in Molten $CaCl_2$," Metallurgical and Materials Transactions B, vol. 34B, pp. 287-295, Jun. 2003 (9 pp.).

Suzuki et al., "Calciothermic Reduction of Titanium Oxide in Molten $CaCl_2$," Metallurgical and Materials Transactions B, vol. 34B, pp. 277-285, Jun. 2003 (9 pp.).

Suzuki et al., "OS Process: Calciothermic Reduction of $TiO_2$ via CaO Electrolysis in Molten $Cacl_2$," Extractive Metallurgy of Titanium, Ch. 12, pp. 287-313, Jan. 24, 2020 (27 pp.).

TREATMENT OF METAL ORES

FIELD OF THE INVENTION

The present invention relates to a method of refining a metal, particularly titanium or a rare-earth metal, and particularly but not exclusively, from ores comprising metal oxides and at least 1.0 wt % impurities including calcium oxide and iron oxide.

BACKGROUND ART

Many metals, such as titanium, have remarkable properties but their applications are restricted by the high cost of extraction and processing. For example, the Kroll or Hunter Processes require high purity titanium tetrachloride which is either reduced with magnesium (Kroll Process) [W. J. Kroll, Trans. Electrochem. Soc., 78 (1940) 35-57] or sodium (Hunter Process) [M. A. Hunter, J. Am. Chem. Soc., 32 (1910) 330-336]. The high purity titanium tetrachloride is produced by carbo-chlorination of the impure titanium dioxide and as all the oxides chlorinate, the impurities are removed by selective distillation of the chlorides. The other way of making high purity titanium dioxide, usually for the pigment industry, is the sulphate route where the impure titanium dioxide is dissolved in sulphuric acid and the iron, which is the major impurity, precipitated as iron oxide. However, there are several sources of titanium oxide which contain impurities or are too fine and render the conventional routes impractical. For example, titanium ores containing significant quantities of calcium oxide form, in the carbo-chlorination process, calcium chloride which melts below the temperature of the fluidised bed reactor. This liquid phase de-fluidises the bed. The particle size of some other ore bodies are too fine to remain in a fluidised bed and are simply swept away. Use of the sulphuric acid route results in the formation of stable calcium sulphate when calcium oxide containing ores are leached. It would be advantageous if these and other materials could be simply converted into high purity metals.

As mentioned above, there are two commercial methods, Kroll and Hunter, for the production of titanium using high purity titanium chloride with the vast majority being produced by the Kroll Process. In order to reduce the cost of titanium production, other methods have been investigated, usually starting with high purity oxide. In laboratory and pilot plant scale experiments, titanium dioxide has been reduced using calcium dissolved in calcium chloride (OS Process) [R. O. Suzuki in "Ti-2003 science and technology". Eds G. Lutjering and J. Albrecht, (2004, Wiley-VCH, Weinheim) 245-252.] or electrochemically by electro-deoxidation in molten calcium chloride (FFC Cambridge Process) [G. Z. Chen, D. J. Fray and T. W. Farthing, Nature 407 (2000) 361-364]. In the latter process, the titanium oxide is made the cathode in a bath of calcium chloride and it is found that the cathodic reaction is not the deposition of calcium from the melt $$Ca^{2+}+2e^{-}=Ca$$

but the ionisation of the oxygen in the titanium dioxide, which diffuses to the anode and is discharged.

$$O+2e^{-}=O^{2-}$$

$$O^{2-}=\tfrac{1}{2}O2+2e^{-}$$

In both these processes, ores containing calcium oxide can be treated as the calcium oxide would simply dissolve in the salt. However, there would not be any selective removal of the other elements as the final product would be a reflection of the impurities in the original feed material. Other processes, such as the Armstrong Process—'Summary of emerging titanium cost reductions', EHK Technologies.

Report prepared for US Department of Energy and Oak Ridge National Laboratory, subcontract 4000023694 (2003) which is a derivative of the Hunter Process, all require high purity titanium tetrachloride as the feedstock.

Another process of interest, is that patented by Wainer in the 1950s [U.S. Pat. No. 2,722,509], which describes a process where equimolar amounts of finely divided chemically pure titanium carbide and finely divided chemically pure titanium monoxide were intimately admixed and heated in an argon atmosphere to form a TiC·TiO anode, a mutual solid solution of titanium carbide and titanium monoxide in which the molar ratio of the carbide to the monoxide does not exceed 1. A melt of a chloride salt of an electropositive element is used as an electrolyte and when a voltage is applied, anodic reactions of the following type occur:

$$TiCO=Ti^{2+}+CO+2e^{-}$$

The titanium ions dissolve into the electrolyte, and are reduced at the cathode:

$$Ti^{2+}+2e^{-}=Ti$$

Withers and co-workers have also investigated thermal and electrochemical processes for production of titanium see WO 2005/019501 and WO 2007/097823. The process involves forming a titanium oxide-carbon composite by mixing titanium oxide with a source of carbon and heating in the absence of air to a temperature sufficient to reduce the plus four valance of the titanium in the $TiO_2$ to a lower valence and form a titanium suboxide/carbon composite electrode. In the process of forming the titanium suboxide/carbon composite electrode, any iron oxide is reduced to iron and was removed by leaching or complexing the iron in an acidic aqueous solution at ambient temperature. WO 2005/019501 suggests that by incorporating other oxides into the anode, it is possible to reduce these other oxides at the same time, and deposit the cations simultaneously at the cathode to produce an alloy which reflects the composition of the original anode. In the same document, a method of producing high purity titanium is described which uses the same conditions as the previous experiments. These two results are totally inconsistent.

The present applicants have sought to provide a method of refining titanium and other metals from ores comprising metal oxides with relatively high levels (e.g. at least 1.0 wt %) impurities including calcium oxide and iron oxide.

In WO 2011/015845 (the entire contents of which are hereby incorporated by reference), the present applicant describes a method of producing titanium from an ore comprising titanium dioxide and at least 1.0 wt % impurities including calcium oxide and iron oxide. The method includes the steps of: providing an oxide of titanium having a level of impurities of at least 1.0 wt %; reacting the oxide of titanium to form a titanium oxycarbide; electrolysing the titanium oxycarbide in an electrolyte, with the titanium oxycarbide configured as an anode; and recovering a refined titanium metal from a cathode in the electrolyte. In one example, the titanium oxycarbide was formed by sintering powders of carbon and the oxide of titanium at 1373 K under a vacuum of $10^{-2}$ Torr. Subsequent experiments have focused on reacting the oxide of titanium with carbon at elevated temperatures (e.g. 1500 (1773K) to 1700° C. (1973K) for up to about 20 h to form the oxycarbide. The refined titanium produced by the method, which is known as the Chinuka process, is relatively pure, as highlighted by the following comparison of impurities in the starting and end products:

| Sample | Al(%) | Ca(%) | Cr(%) | Fe(%) | Si(%) |
|---|---|---|---|---|---|
| Concentrate | 0.232 | 0.782 | 0.350 | 0.660 | 1.540 |
| Electrorefined Product | 0.032 | 0.079 | 0.029 | 0.130 | <0.001 |

Recent development research into the Chinuka process has highlighted that the formation of the oxycarbide requires very high temperatures. As the operation of a large (e.g. commercial) scale plant at these temperatures could present significant technical challenges, the present inventors have sought to address this issue and provide an improved Chinuka process.

STATEMENT OF INVENTION

According to a broad aspect, the present invention provides electrorefining of an anode consisting of an impure metal oxycarbide to give a refined metal or more pure metallic material at the cathode, wherein the oxycarbide is formed by electrolytically reducing in a molten calcium chloride electrolyte an electrode comprising carbon and an oxide of the metal. The impure metal oxycarbide may substantially comprise uranium oxycarbide, molybdenum oxycarbide, tungsten oxycarbide, titanium oxycarbide, chromium oxycarbide, scandium oxycarbide, yttrium oxycarbide, lanthanum oxycarbide, manganese oxycarbide, bismuth oxycarbide, hafnium oxycarbide, zirconium oxycarbide and tantalum oxycarbide, as well as certain lanthanide oxycarbides (especially selected from the group consisting of cerium oxycarbide, neodymium oxycarbide, samarium oxycarbide and gadolinium oxycarbide).

In accordance with one aspect of the present invention, there is provided a method of refining a metal, comprising the following steps: (a) providing an oxide of the metal having a level of impurities of at least 1.0 wt %; (b) reacting the oxide of the metal to form an oxycarbide by providing an electrode comprising the oxide of the metal and carbon, and electrolytically reducing the electrode in a molten calcium chloride electrolyte; (c) electrolysing the oxycarbide in an electrolyte, with the oxycarbide configured as an anode; and (d) recovering a refined form of the metal from a cathode in the electrolyte.

The present inventors believe that forming the oxycarbide by electrolytically reducing the (carbon and metal oxide) electrode in the molten calcium chloride electrolyte in step (b) may have significant advantages over previous attempts to form the oxycarbide which rely on high temperature alone, ranging from 1100 to 1700° C. A key advantage comes from the fact that the molten calcium chloride need only be heated to around 850° C. It may also be possible to form the oxycarbide more quickly than hithertobefore, with a complete reaction occurring in 8 hours or less. However, it is not believed to be essential for the reaction to be completed before moving to step (c).

The metal may be selected from the group consisting of titanium and other metals capable of forming oxycarbides such as scandium, chromium, manganese, yttrium, zirconium, niobium, molybdenum, lanthanum and other lanthanides (especially cerium, neodymium, samarium and gadolinium), hafnium, tantalum, tungsten, bismuth and uranium. The metal may even be selected from the group consisting of titanium, the rare-earth metals (especially scandium, yttrium, lanthanum, cerium, neodymium, samarium and gadolinium) and uranium.

The oxide of the metal provided in step (a) may be an ore or ore concentrate, and may be a relatively low purity ore which may be of low intrinsic value (at least compared to ores of higher purity). Alternatively, the oxide may be a used nuclear fuel, such as uranium oxide.

The impurities in the oxide of the metal provided in step (a) may be comprise oxides of other metals and/or silicon. The other metals may include aluminium, calcium, chromium, iron and vanadium.

The method may further comprise leaching impurities from the oxycarbide before step (c) using an acid. Such leaching (e.g. with a strong acid, such as sulphuric acid) may help to remove certain impurities such as iron and/or vanadium prior to electrolysing the oxycarbide in the electrolyte. The method may further comprise removing the electrolytically reduced electrode from the molten calcium chloride electrolyte, and cooling before leaching impurities from the oxycarbide using the acid.

The level of impurities in the oxide of the metal provided in step (a) may be at least 2.0 wt %, perhaps even at least 2.5 wt %. For example, the oxide of the metal being refined may include at least 0.1 wt % calcium oxide, perhaps even at least 0.5 wt % calcium oxide. Additionally or alternatively, the oxide of the metal being refined may include at least 0.1 wt % iron oxide, perhaps at least 0.5 wt % iron oxide, and perhaps even at least 5 wt % iron oxide. The level of impurities in the oxide of the metal provided in step (a) may be less than 20 wt %, perhaps even less than 15 wt %, and perhaps even less than 10 wt %.

The present applicants believe that the refined metal recovered from the cathode in step (d) will have a relatively high purity compared to the impurity levels in the oxide of the metal provided at step (a). The refined metal may have a level of impurities of less than 0.5 wt %, i.e. be at least 99.5% pure by weight, and may even be at least 99.8% pure by weight. The present applicants have found that metallic impurities initially present in the oxide of the metal in step (a), which might be expected to be deposited at the cathode with the metal, are retained in the electrolyte. This may especially be the case when the impurities are selected from the group consisting of oxides of silicon, aluminium, iron, calcium, chromium and vanadium.

In step (b), the electrode comprising the oxide of the metal and carbon may be formed from powders. The powders, which may be mixed with a binder, may be pressed to form a solid body, for example in pellet form. The solid body may be sintered to improve upon initial green strength. The solid body may be placed in a porous electrically conducting holder for immersion into the molten calcium chloride electrolyte.

The electrolyte in step (c) may be a molten salt, and may comprise a chloride of an alkali or alkali-earth metal. The molten salt may be selected from the group consisting of lithium chloride, sodium chloride, potassium chloride, magnesium chloride and mixtures thereof. The molten salt may comprise a sodium chloride-potassium chloride eutectic or a lithium chloride-sodium chloride-potassium chloride eutectic. Alternatively, the molten salt may be magnesium chloride. Such a salt boils at 1412° C. and is distilled away from the cathodic product; the other salts can only be removed by dissolving in water which may cause the refined metal recovered at step (d) to be oxidised.

Alternatively, the electrolyte in step (c) may also be molten calcium chloride, and may even be the same electrolyte used in step (b). For example, following formation of the oxycarbide in step (b) whilst using a carbon anode, the carbon anode is replaced with an inert electrode and the polarity is reversed such that the oxycarbide is made anodic. It is believed that the metal from the oxycarbide will be ionised, with the resultant ions diffusing through the electrolyte to the inert electrode which is cathodic and where electrolytically refined metal metal is deposited (e.g. by plating the inert electrode) for subsequent recovery.

An embodiment of the present invention will now be defined with reference to titanium as the metal being refined, to provide a better understanding of the present invention. It will be understood that references to titanium below may be replaced mutatis mutandis by any of the other metals capable of forming oxycarbides such as rare-earth metals, as discussed above.

In step (a), the oxide of titanium may be provided in the form of an impure ore comprising ilmenite ($FeTiO_3$). In step (b), the electrode comprising the oxide of titanium and carbon is configured as a cathode and the following cathodic reaction is believed to occur in the molten calcium chloride electrolyte, resulting in the formation of titanium oxycarbide:

$$2FeTiO_3+6C=Ti_2CO+2Fe+5CO$$

A carbon anode may be used in step (b), in which case the following anodic reaction may occur:

$$2O^{2-}+C=CO_2+4e^-$$

In step (c), the titanium oxycarbide is configured as an anode in an electrolyte such as a molten salt electrolyte, where the following reactions occur:

$$Ti_2CO=_2Ti^{2+}+CO+_2e^-$$

with the cathodic reaction being:

$$2Ti^{2+}+2e^-=2Ti$$

The titanium collected at the cathode in step (d) is substantially pure in comparison to the impure oxide of titanium provided at step (a), even without the optional acid leaching of the oxycarbide between steps (b) and (c).

After step (b), the titanium oxycarbide may be isolated from the electrolyte and leached with an acid to remove iron impurities, for example originating from the impure ore in step (a). For example, the titanium oxycarbide may be removed from the molten calcium chloride electrolyte, or may be separated from solidified calcium chloride electrolyte. The isolated titanium oxycarbide may be in powder form and, once cooled, may be added to the acid for leaching and to allow any iron to be removed. The leached sediment is collected, and dried. The resulting powder is mixed with a binder and pressed to form conducting pellets (ie, a solid). The pellets are then sintered. The pellets are placed inside a porous conducting holder for immersion into the liquid salt bath. It is not essential that the reaction goes to completion before moving to step (c) The present applicants believe that the refined titanium metal recovered from the cathode in step (d) will have a relatively high purity compared to the impurity levels in the oxide of titanium provided at step (a). The refined titanium metal may have a level of impurities of less than 0.5 wt %, i.e. be at least 99.5% pure by weight, and may even be at least 99.8% pure by weight. The present applicants have found that impurities initially present in the oxide of titanium, which might be expected to be deposited at the cathode with the titanium, are retained in the electrolyte. The oxide of titanium may be an ore or ore concentrate and may comprise impurities selected from the group consisting of oxides of silicon, aluminium, iron, calcium, chromium and vanadium. In one arrangement, the oxide of titanium has impurities including oxides of iron and/or calcium. The presence of such impurities interferes with extraction of titanium using conventional techniques, particularly if the oxides of calcium and/or iron are present in significant quantities. For example, the presence of more than about 0.15 wt %-0.2 wt % calcium oxide may preclude processing in a fluidised bed reactor due to melting of calcium chloride resulting from an earlier carbo-chlorination step. Consequently, an ore containing titanium dioxide and significant levels of calcium oxide and iron oxide has a significantly lower value than other ores with nothing more than minimum or trace levels of calcium oxide and/or iron oxide.

The oxide of titanium may have a level of impurities of at least 2.0 wt %, perhaps even at least 2.5 wt %. The oxide of titanium may include at least 0.1 wt % calcium oxide, perhaps even at least 0.5 wt % calcium oxide. Additionally or alternatively, the oxide of titanium may include at least 0.1 wt % iron oxide, perhaps at least 0.5 wt % iron oxide, and perhaps even at least 5 wt % iron oxide. The refined titanium metal may include a lower level of calcium and/or iron than the oxide of titanium.

The oxide of titanium may substantially comprise titanium dioxide. For example, the oxide of titanium may comprise at least 90 wt % titanium dioxide, and possibly even at least 95 wt % titanium dioxide. The electrolyte in step (c) may be a molten salt, and may comprise a chloride of an alkali or alkali-earth metal. The molten salt may be selected from the group consisting of lithium chloride, sodium chloride, potassium chloride, magnesium chloride and mixtures thereof. The molten salt may comprise a sodium chloride-potassium chloride eutectic or a lithium chloride-sodium chloride-potassium chloride eutectic. Alternatively, the molten salt may be magnesium chloride. Such a salt boils at 1412° C. and is distilled away from the cathodic product; the other salts can only be removed by dissolving in water which causes the titanium to be oxidised. The molten salt may further comprise titanium (II) chloride ($TiCl_2$) and/or titanium (III) chloride ($TiCl_3$). The presence of titanium chloride (perhaps a few percent by weight) may help transportation of titanium ions through the salt. The method may further comprise removing impurities from the electrolyte in step (c) by treating the molten electrolyte with titanium, for example at a temperature of 700° C.

Alternatively, the electrolyte in step (c) may also be molten calcium chloride, and may even be the same electrolyte used in step (b). For example, following formation of the titanium oxycarbide in step (b) whilst using a carbon anode, the carbon anode is replaced with an inert electrode and the polarity is reversed such that the titanium oxycarbide is anodic. It is believed that titanium from the titanium oxycarbide will be ionised, with the resultant titanium ions diffusing through the electrolyte to the inert electrode which is cathodic and where electrolytically refined titanium metal is deposited (e.g. by plating the inert electrode) for subsequent recovery. The reactions are:

(i) at the anode, $Ti_2CO=_2Ti^{2+}+CO(g)+4e^-$; and (ii) at the cathode, $2Ti^{2+}+4e^-=2Ti$ In accordance with another aspect of the present invention, there is provided a method of refining a metal (e.g. titanium or a metal capable of forming oxycarbides such as a rare-earth metal), comprising: providing an ore or ore concentrate comprising an oxide of the metal; reacting the ore or ore concentrate to form an oxycarbide of the metal; electrolysing the oxycarbide of the metal in an electrolyte, with the oxycarbide of the metal configured as an anode; and recovering the metal from a cathode in the electrolyte, characterized in that the oxycarbide of the metal is formed by electrolytically reducing a mixture of the ore or ore concentrate with carbon using the FFC Cambridge process.

The ore or ore concentrate may comprise impurities (as defined with the previous aspect). The recovered metal may have a higher purity (lower level of impurities in relative terms), with the level of the metal increasing from less than 98% by weight in the ore or ore concentrate to at least 99.5% by weight in the recovered metal, and possibly even at least 99.8% by weight.

BRIEF DESCRIPTION OF DRAWINGS

An embodiment of the invention will now be described in detail, by way of example, and with reference to the accompanying drawings, in which.

SPECIFIC DESCRIPTION OF EMBODIMENT OF INVENTION

Electrorefining in molten salts is used commercially to produce high purity molten aluminium by dissolving the aluminium into a copper-aluminium alloy. This is made the anode and the aluminium being the most reactive element is ionised into the salt and deposited at the cathode with the impurities remaining in the anode. The ionisation potentials for the pure elements for a chloride melt relative to $Na/Na^+$, at 1173 K, are $Al=Al^{3+}+3e$ $E^o=+1.72$ V $Si=Si^{4+}+4e$ $E^o=+2.27$ V $Mn=Mn^{2+}+2e$ $E^o=+1.63$ V $Fe=Fe^{2+}+2e$ $E^o=+1.98$ V In an alloy of these elements, manganese should ionise first followed by Al, Fe and Si.

The same principle can be applied to the refining of other metals but in this invention, the reactions are not the refining from liquid metals but the refining of metal from metal oxides. A typical composition of a titanium ore is given in Table 1 below:

| Oxide | Wt. % |
|---|---|
| $TiO_2$ | 96.5 |
| $SiO_2$ | 1.4 |
| $Al_2O_3$ | 0.26 |
| $Fe_2O_3$ | 0.55 |
| MgO | 0.07 |
| CaO | 0.66 |
| $Na_2O$ | 0.08 |
| $K_2O$ | 0.01 |
| $Cr_2O_3$ | 0.31 |
| $V_2O_5$ | 0.30 |
| LOI | 0.07 |

If this material is reacted with C it will form $TiC_xO_y$ and other oxycarbides, but these dissolve in the titanium oxycarbide at very low concentrations so that when an anodic potential is applied only the titanium will ionise and plate out on the cathode.

Once in the electrolyte, the deposition potentials should be given by Table 2 below and the order of deposition chromium, iron, titanium magnesium and, finally, calcium.

| Reaction | Potential relative to Na+ + e− = Na (V) |
|---|---|
| $Cr^{2+} + 2e^- = Cr$ | 2.07 |
| $Mg^{2+} + 2e^- = Mg$ | 0.83 |
| $Ti^{2+} + 2e^- = Ti$ | 1.68 |
| $Fe^{2+} + 2e^- = Fe$ | 1.99 |
| $Ca^{2+} + 2e^- = Ca$ | −0.18 |

These potentials will be influenced by the activities of the ions in the salt so that if the activity of the species is low, it will be more difficult to deposit the metal form that species.

The overall conclusion of these calculations is that it is very likely the calcium, being highly electropositive, will be retained by the electrolyte. Surprisingly, it was found that by electrorefining the oxycarbide, made from an ore with the composition given in Table 1, titanium with a very low impurity content of the other elements was deposited on the cathode.

Example

Figure 1:
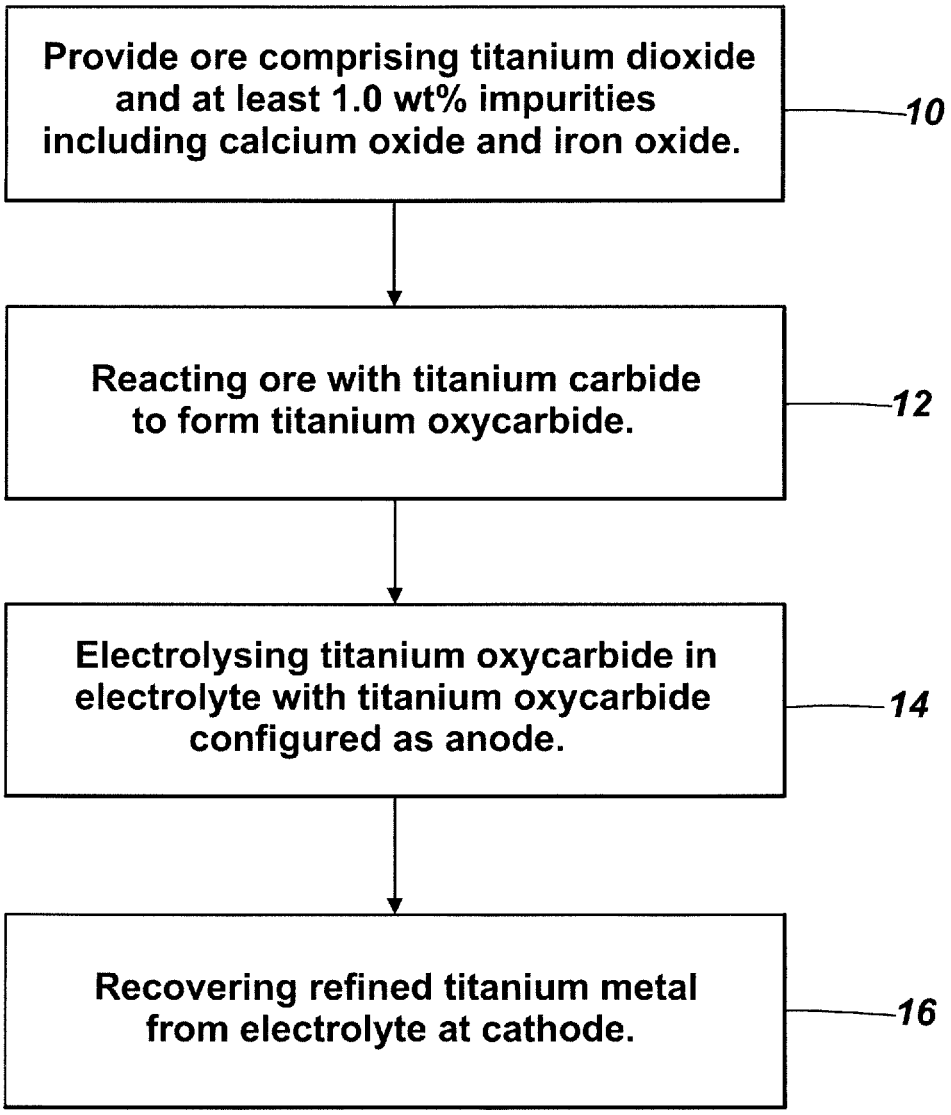
FIG. 1 is a flow chart illustrating steps of a method for refining titanium from an ore comprising titanium dioxide.

A broad method of producing titanium from an ore (such as the ore whose composition is given in Table 1) is illustrated in FIG. 1. Having provided the ore at step 10, a titanium oxycarbide is formed at step 12. The titanium oxycarbide is electrolysed at step 14, and refined titanium metal recovered at the cathode at step 16.

The oxycarbide is prepared (step 12) by mixing an ore of the composition shown in Table 1, in powder form, with carbon powder in accordance with the stoichiometry given by the equation: $2TiO_2+C+6e^-=Ti_2CO+3O^{2-}$. The powders are pressed into pellets 2 mm diameter and 2 mm thickness using an uniaxial pressure of 2.65 tons $cm^{-2}$.

Figure 2:
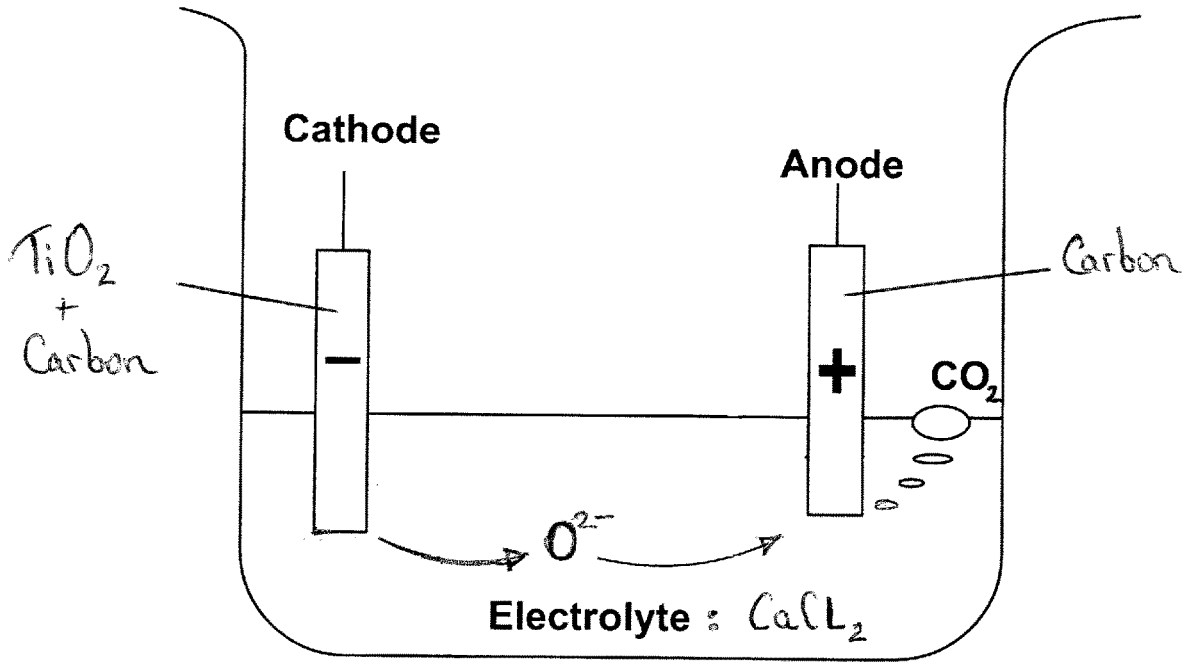
FIG. 2 is a schematic diagram of an electrolytic cell for forming titanium oxycarbide ($Ti_2CO$) used in one step of the method illustrated in FIG. 1.

FIG. 2 shows schematically an electrolytic cell for electrolytically reducing an electrode formed from the pressed powder pellets. The mixed $TiO_2$ and C electrode is configured as the cathode and electrolysed in a molten calcium chloride ($CaCl_2$)) electrolyte to form titanium oxycarbide. With a carbon anode, the following reactions occur:

$$2TiO_2+C+6e^-=Ti_2CO+3O^{2-}$$

$$2O^{2-}+CCO_2+4e^-$$

At this stage, the only intention is to form the titanium oxycarbide: there is no intention to electrolytic refine the titanium ore. However, once the titanium oxycarbide has been formed, electrolytic refining may be carried in a number of ways, as explained below:

Option 1

Figure 3:
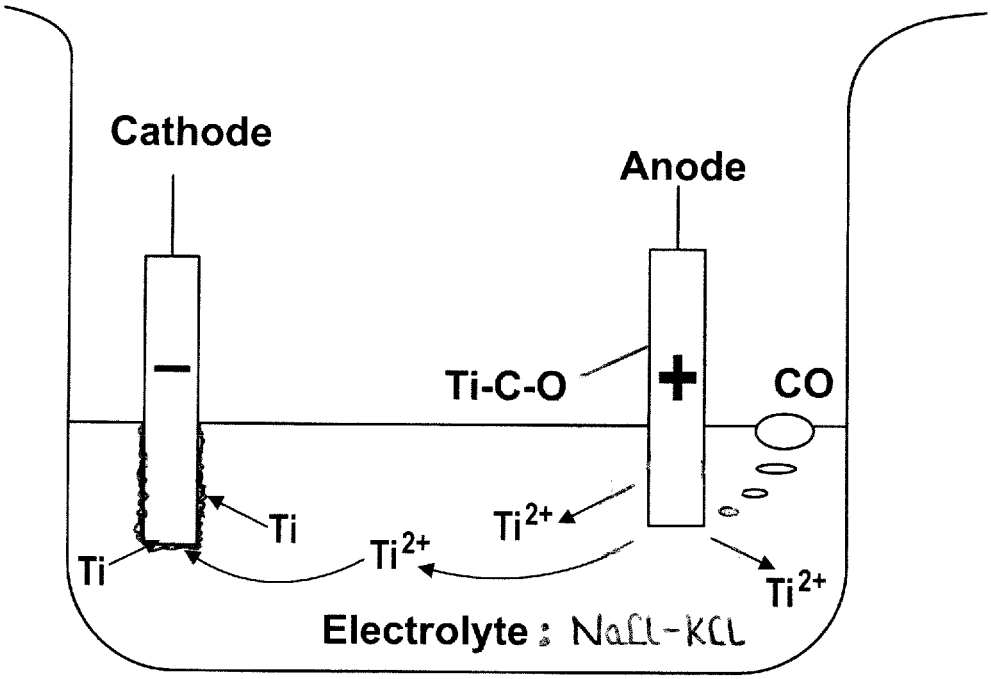
FIG. 3 is a schematic diagram of an electrorefining cell used in another step of the method illustrated in FIG. 1.

FIG. 3 shows schematically an electrorefining cell. The titanium oxycarbide ($Ti_2CO$) is configured as the anode and electrolysed in a molten salt electrolyte (step 14), such as eutectic NaCl—KCl or eutectic LiCl—NaCl—KCl, containing some $TiCl_2$ and $TiCl_3$. Metal deposited at the cathode during electrolysis (step 16) was collected.

Option 2

Figure 4:
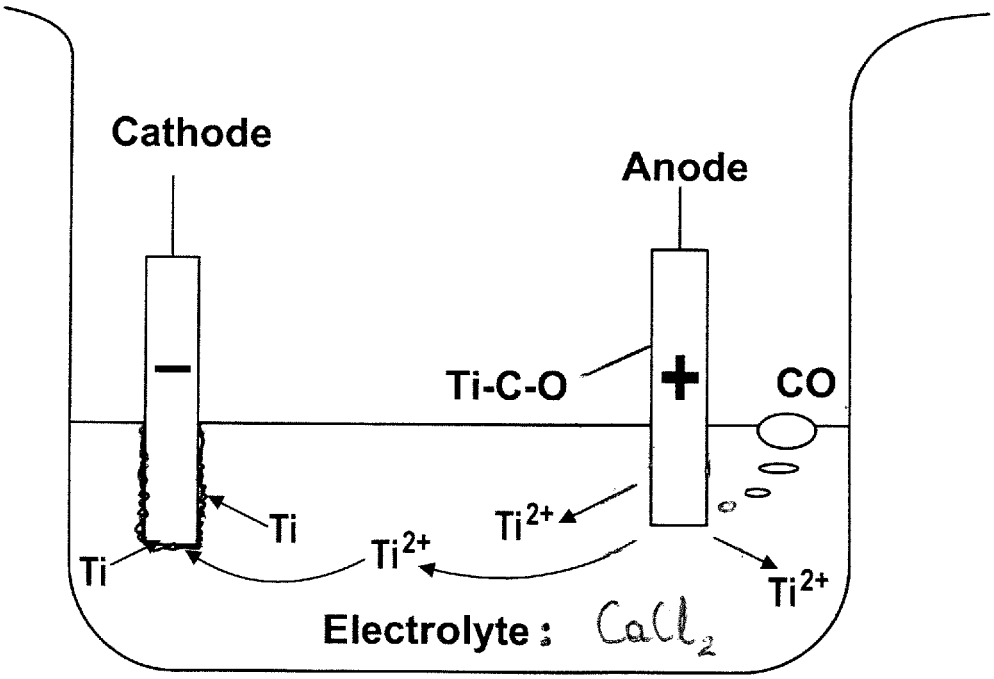
FIG. 4 is a schematic diagram of an alternative electrorefining cell to the one illustrated in FIG. 3.

FIG. 4 shows an alternative electrorefining cell which is derived from the electrolytic cell of FIG. 2, and so retains molten calcium chloride as the electrolyte. The carbon anode has been replaced with an inert electrode, and the polarity has been reversed so that the newly formed titanium oxycarbide electrode is re-configured as the anode. During electrolysis, titanium from the titanium oxycarbide will be ionised, with the resultant titanium ions diffusing through the electrolyte to the inert electrode which is cathodic and where electrolytically refined titanium metal is deposited (e.g. by plating the inert electrode) for subsequent recovery (step 16). The reactions are:

(i) at the anode, $Ti_2CO={}_2Ti^{2+}+CO(g)+4e^-$; and (ii) at the cathode, $2Ti^{2+}+4e^-=2Ti$

The invention claimed is:

1. A method of refining a metal capable of forming an oxycarbide, comprising the following steps:

(a) providing an oxide of the metal;

(b) reacting the oxide of the metal to form the oxycarbide by:

providing an electrode comprising the oxide of the metal and carbon; and electrolytically reducing the electrode in a molten calcium chloride electrolyte;

(c) electrolyzing the oxycarbide in the molten calcium chloride electrolyte by reversing electrolytic cell polarity such that the oxycarbide is configured as an anode; and (d) recovering a refined form of the metal from a cathode in the molten calcium chloride electrolyte;

wherein the oxide of the metal has a level of impurities of at least 1.0 wt %; and wherein the impurities are leached from the oxycarbide before step (c) using acid.

2. The method according to claim 1, in which the refined form of the metal is at least 99.5% pure by weight.

3. The method according to claim 1, in which the oxide of the metal is an ore or ore concentrate.

4. The method according to claim 1, in which the oxide of the metal comprises oxides of silicon, aluminum, iron, calcium, chromium and/or vanadium.

5. The method according to claim 1, in which the oxide of the metal includes at least 0.1 wt % calcium oxide and/or at least 0.1 wt % iron oxide.

6. The method according to claim 1, in which the level of the impurities in the oxide of the metal provided in step (a) is less than 20 wt %.

7. The method according to claim 1, in which a carbon anode is used in step (b).

8. The method according to claim 7, in which the carbon anode is replaced with an inert electrode in step (c).

9. The method according to claim 1, in which the metal includes titanium, scandium, chromium, manganese, yttrium, zirconium, niobium, molybdenum, lanthanum, cerium, neodymium, samarium, gadolinium, hafnium, tantalum, tungsten, bismuth and/or uranium.

10. The method according to claim 1, in which the metal includes titanium, scandium, yttrium, lanthanum, cerium, neodymium, samarium, gadolinium, and/or uranium.

11. The method according to claim 1, in which the metal is titanium.

* * * * *